US011118840B2

(12) United States Patent
Cohen et al.

(10) Patent No.: US 11,118,840 B2
(45) Date of Patent: Sep. 14, 2021

(54) HEAT EXCHANGER AND MODULE THEREOF

(71) Applicant: MAGEN ECO ENERGY A.C.S. LTD, Kibbutz Magen (IL)

(72) Inventors: Rotem Cohen, Holon (IL); Michel Ben Gavriel Plaschkes, Kibbutz Magen (IL)

(73) Assignee: MAGEN ECO ENERGY A.C.S. LTD, Kibbutz Magen (IL)

( * ) Notice: Subject to any disclaimer, the term of this patent is extended or adjusted under 35 U.S.C. 154(b) by 341 days.

(21) Appl. No.: 16/340,803

(22) PCT Filed: Oct. 3, 2017

(86) PCT No.: PCT/IL2017/051120

§ 371 (c)(1),
(2) Date: Apr. 10, 2019

(87) PCT Pub. No.: WO2018/069919

PCT Pub. Date: Apr. 19, 2018

(65) Prior Publication Data

US 2019/0257587 A1 Aug. 22, 2019

(30) Foreign Application Priority Data

Oct. 10, 2016 (IL) ..... 248304

(51) Int. Cl.
*F28D 7/00* (2006.01)
*F28F 9/02* (2006.01)
(Continued)

(52) U.S. Cl.
CPC ..... *F28D 7/0066* (2013.01); *F28D 1/05341* (2013.01); *F28D 1/05391* (2013.01);
(Continued)

(58) Field of Classification Search
CPC ..... F28D 7/0066; F28D 1/05341; F28D 1/05391; F28F 9/02; F28F 9/0217;
(Continued)

(56) References Cited

U.S. PATENT DOCUMENTS 4,619,315 A * 10/1986 Waryasz ..... B01J 8/1836 122/4 D
4,923,004 A * 5/1990 Fletcher ..... F28F 21/062 165/175

(Continued)

FOREIGN PATENT DOCUMENTS

AU 5362079 A 9/1980
CH 129087 A 12/1928

(Continued)

OTHER PUBLICATIONS

"Plastic Gas-Liquid Heat Exchanger" Calorplast Waermetechnik, (retrieved online Sep. 27, 2016), www.calorplast-waermetechnik.de/en/products/plastic-heat-exchangers/plastic-gas-liquid-heat-exchanger/.

(Continued)

*Primary Examiner* — Jon T. Schermerhorn, Jr.
(74) *Attorney, Agent, or Firm* — Vorys, Sater, Seymour and Pease LLP; Anthony P. Venturino

(57) ABSTRACT

A module for constructing therefrom a heat exchanger is provided. The module includes two manifolds and a plurality of parallelly arranged mats spanning between the manifolds. Each mat includes a plurality of heat exchange tubes arranged so as to define a plane, the heat exchange tubes being in fluid communication with the manifolds and spanning therebetween. Each of the manifolds includes selectively sealable end openings formed in facing ends thereof and defining a longitudinal flow path substantially perpendicular to the tubes and parallel with the planes defined thereby. Each of the manifolds further includes selectively (Continued)

sealable side openings on facing sides thereof and each defining a lateral flow path substantially perpendicular to the longitudinal flow path and to the planes defined by the tubes.

20 Claims, 7 Drawing Sheets

(51) Int. Cl.
*F28F 21/06* (2006.01)
*F28D 1/053* (2006.01)
*F28F 9/16* (2006.01)

(52) U.S. Cl.
CPC ..... *F28F 9/02* (2013.01); *F28F 9/0217* (2013.01); *F28F 9/16* (2013.01); *F28F 9/162* (2013.01); *F28F 21/06* (2013.01); *F28F 21/062* (2013.01); *F28F 2255/02* (2013.01); *F28F 2255/146* (2013.01)

(58) Field of Classification Search
CPC .... F28F 9/16; F28F 9/162; F28F 21/06; F28F 21/062; F28F 2255/02; F28F 2255/146
See application file for complete search history.

(56) References Cited

U.S. PATENT DOCUMENTS 5,582,238 A * 12/1996 Plaschkes ..... F28F 9/0214 165/56
6,161,616 A * 12/2000 Haussmann ..... B60H 1/3227 165/152
9,863,722 B2 * 1/2018 Kim ..... F28F 9/0212
10,048,010 B2 * 8/2018 Cheong ..... F28D 1/05391
10,126,065 B2 * 11/2018 Pautler ..... F28D 1/05375
10,690,380 B2 * 6/2020 Cohen ..... F24S 10/742
2005/0247443 A1 * 11/2005 Kim ..... F28F 9/0207 165/176
2010/0206532 A1 * 8/2010 Alahyari ..... F28F 9/028 165/173
2011/0030935 A1 * 2/2011 Riondet ..... F28F 9/0209 165/173
2011/0088885 A1 * 4/2011 Samuelson ..... F28F 1/126 165/176
2012/0267085 A1 * 10/2012 Plaschkes ..... F28F 9/187 165/173
2016/0370119 A1 * 12/2016 Pautler ..... F28D 1/05375
2017/0219249 A1 * 8/2017 Cohen ..... F24S 10/753

FOREIGN PATENT DOCUMENTS

CN 102297614 A 12/2011
DE 10 2009 013 280 A1 9/2010
DE 10 2012 011 926 A1 12/2013
EP 0 683 373 A1 11/1995
FR 499 085 A 1/1920
GB 2472782 A 2/2011
WO 2011/084613 A2 7/2011

OTHER PUBLICATIONS

"Plastic Immersion-Type Heat Exchanger" Calorplast Waermetechnik, (retrieved online Sep. 27, 2016), www.calorplast-waermetechnik.de/en/products/plastic-heat-exchangers/plastic-immersion-type-heat-exchanger/.
"CALORPLAST Immersion Type Polymer Heat Exchanger" Calorplast Waermetechnik, (retrieved online Sep. 27, 2016), www.calorplast-waermetechnik.de/wp-content/uploads/immersion-type-heat-exchanger.pdf.
"CALORPLAST—Immersion Style Heat Exchanger" Calorplast Waermetechnik, (retrieved online Sep. 27, 2016), www.calorplast-waermetechnik.de/wp-content/uploads/bad-waermetauscher-dokument.pdf.
"CALORPLAST Gas / Liquid Polymer Heat Exchanger" Calorplast Waermetechnik, (retrieved online Sep. 27, 2016), www.calorplast-waermetechnik.de/wp-content/uploads/gas-liquid-heat-exchanger.pdf.
"CALORPLAST—Gas-Liquid Heat Exchanger" Calorplast Waermetechnik, (retrieved online Sep. 27, 2016), www.calorplast-waermetechnik.de/wp-content/uploads/gas-wasser-waermetauscher-dokument.pdf.

* cited by examiner

HEAT EXCHANGER AND MODULE THEREOF

FIELD OF THE INVENTION

This disclosure relates to heat exchangers. In particular, it relates to heat exchangers which may be assembled modularly.

BACKGROUND

Heat exchangers are commonly used in diverse application to expel and/or capture heat. They may include a plurality of pipes or tubes which contain a heat exchange fluid flowing therethrough, and which is exposed to an environment of a higher or lower temperature. As the heat exchange fluid flows through the tubes, the temperature thereof is brought closer to that of the environment, thereby cooling or heating it, as per the required design.

SUMMARY

According to one aspect of the presently disclosed subject matter, there is provided a module for constructing therefrom a heat exchanger, the module comprising:

two manifolds; and a plurality of parallelly arranged mats spanning between the manifolds, each mat comprising a plurality of heat exchange tubes arranged so as to define a plane, the heat exchange tubes being in fluid communication with the manifolds and spanning therebetween;

wherein each of the manifolds comprises selectively sealable end openings formed in facing ends thereof and defining a longitudinal flow path substantially perpendicular to the tubes and parallel with the planes defined thereby; and wherein each of the manifolds further comprises selectively sealable side openings on facing sides thereof and each defining a lateral flow path substantially perpendicular to the longitudinal flow path and to the planes defined by the tubes.

Each of the mats may further comprise two headers configured for bringing the tubes into fluid communication with the manifolds, and each being connected between the tubes and one of the manifolds.

The headers may be overmolded on the tubes.

The headers may comprise positioning features, each configured to cooperate with a corresponding positioning feature of an adjacent header to facilitate positioning thereof.

Each of the side openings may be defined by a side-lip configured to lie in registration with a side-lip of an identical manifold.

Each of the end openings may be defined by an end-lip configured to lie in registration with an end-lip of an identical manifold.

The module may further comprise caps configured to be selectively connected to one or more of the side and end openings to seal it.

According to another aspect of the presently disclosed subject matter, there is provided a module for constructing therefrom a heat exchanger, the module comprising:

two manifolds; and a plurality of parallelly arranged mats spanning between the manifolds, each mat comprising a plurality of heat exchange tubes arranged so as to define a plane, the heat exchange tubes being in fluid communication with the manifolds and spanning therebetween;

wherein at least one of the manifolds comprises a division arrangement configured to facilitate selectively fluidly isolating one or more of the mats from the tubes of the other mats.

The division arrangement may be configured to divide an internal fluid chamber of the manifold along a plane substantially parallel to the planes defined the mats.

The division arrangement may comprise one or more pairs of oppositely disposed slots on an interior surface of the manifold and be configured to receive a partition spanning therebetween. The slots may extend longitudinally along the length of the manifold.

According to a further aspect of the presently disclosed subject matter, there is provided a module for constructing therefrom a heat exchanger, the module comprising:

two manifolds; and a plurality of parallelly arranged mats spanning between the manifolds, each mat comprising a plurality of heat exchange tubes arranged so as to define a plane and being spaced from one another giving rise to gaps therebetween, the heat exchange tubes being in fluid communication with the manifolds and spanning therebetween;

wherein each of the gaps is disposed such that it overlaps with projections, in a direction perpendicular to the planes, of one or more tubes of other of the mats.

A majority of the gaps in each mat may be of the same size, with each of the mats further comprising one or more, e.g., two, auxiliary gaps of a different size, for example smaller.

The auxiliary gaps may be formed adjacent extreme tubes disposed on one end of their respective tubes.

The mats may be arranged such that extreme tubes of adjacent mats are on alternate sides thereof from one another. Each mat may further comprise a support element configured to grip each of the tubes and maintain its position, each of the support elements being further configured to be rigidly connected to a support element of an adjacent mat so as to preclude an arrangement wherein the mats overlie one another with the extreme tubes thereof on the same sides thereof. The support elements may each comprise a linking arrangement configured to cooperate with the linking arrangement of an adjacent support element to facilitate the rigid connection. The linking arrangements may comprise tabs and slots.

Each of the gaps may be disposed such that it overlaps with projections, in a direction perpendicular to the planes, of a tube of an adjacent mat. Each of the gaps may fully overlap with the projections.

According to a still further aspect of the presently disclosed subject matter, there is provided a module for constructing therefrom a heat exchanger, the module comprising:

two manifolds; and a plurality of parallelly arranged mats spanning between the manifolds, each mat comprising a plurality of heat exchange tubes arranged so as to define a plane, the heat exchange tubes being in fluid communication with the manifolds and spanning therebetween;

wherein each mat comprises one or more support elements disposed coplanar therewith and transverse to the tubes, the support elements configured to grip each of the tubes and maintain its position, each of the support elements being further configured to be rigidly connected to a support element of an adjacent mat.

The support elements may each comprise a linking arrangement configured to cooperate with the linking arrangement of an adjacent support element to facilitate the rigid connection.

The linking arrangement may facilitate snapping connection with an adjacent support element.

The linking arrangements may comprise tabs and slots.

It will be appreciated that a module according to any of the preceding aspects may be provided according to any one or more of the other preceding aspects, including optional features thereof.

According to a still further aspect of the presently disclosed subject matter, there is provided a heat exchanger comprising one or more modules as described above.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION

Figure 1A:
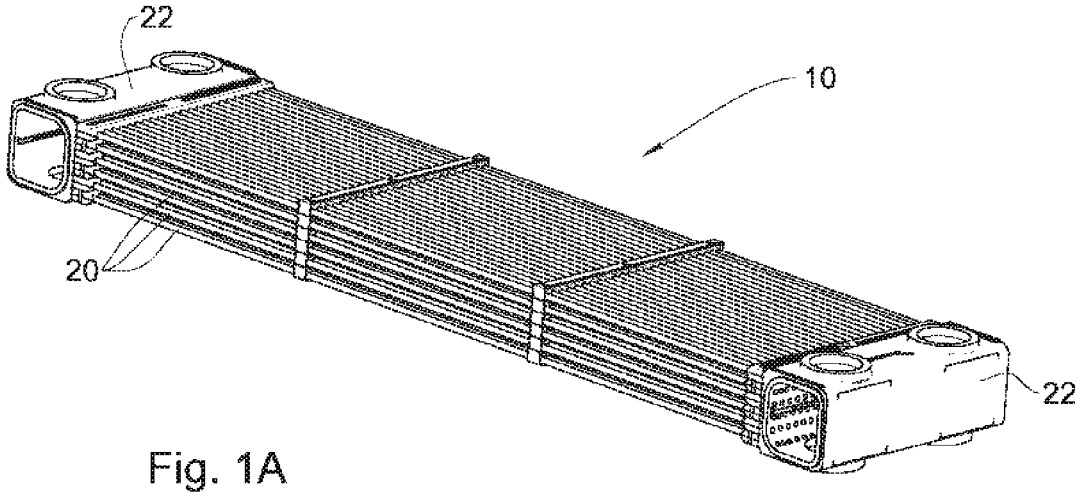
FIG. 1A is a perspective view of a heat exchange module, according to the presently disclosed subject matter.
Figure 1B:
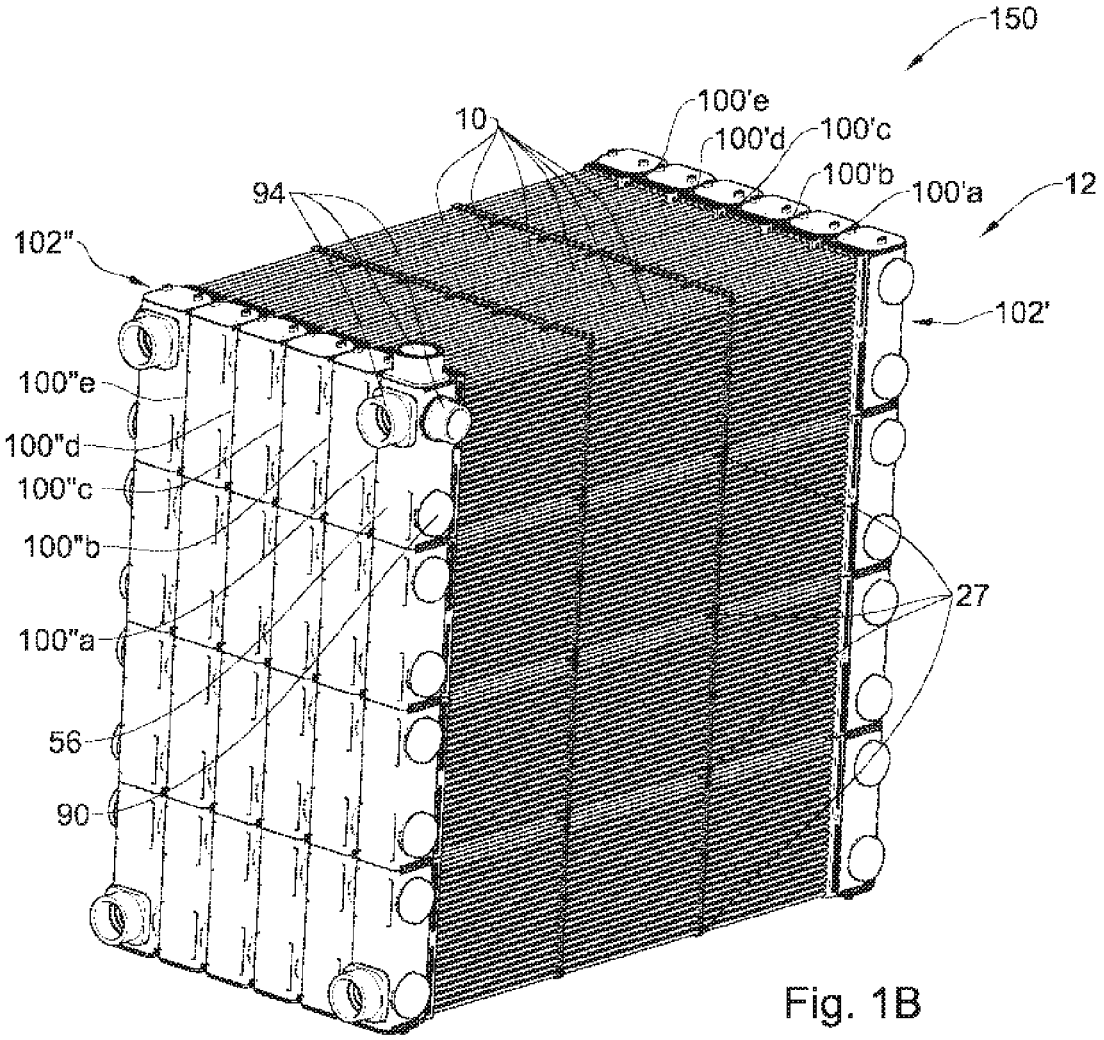
FIG. 1B is a perspective view of a heat exchanger made of modules as illustrated in FIG. 1A.

As illustrated in FIG. 1A, there is provided a heat exchange module, which is generally indicated at 10, for constructing a heat exchanger, for example as indicated at 12 in FIG. 1B. Each module 10 comprises a plurality of mats 20 connected at each end thereof to a manifold 22. The elements of the modules 10 may be made of any suitable material. According to some examples, they are made of a polymeric material, for example one which can withstand corrosive environments and/or working fluids flowing therethrough, e.g., in accordance with the conditions under which it is designed to operate. It will be appreciated that the module 10 may be provided such that all constituent elements thereof are made from the same material, or such that at least some are made from different materials.

Figure 2:
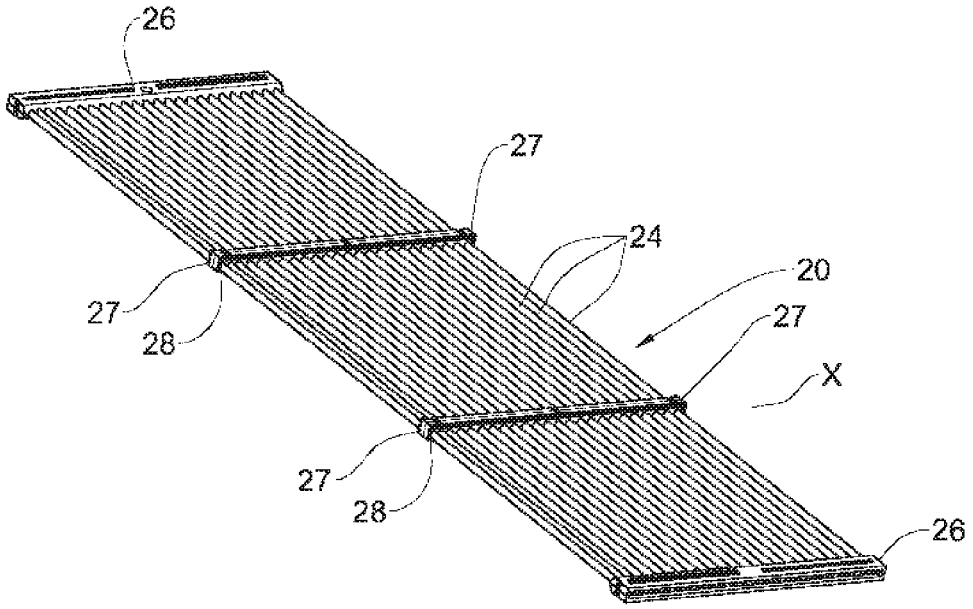
FIG. 2 is a mat of the module illustrated in FIG. 1A.

As better seen in FIG. 2, each of the mats 20 comprises a plurality of planarly-arranged heat exchange tubes 24 defining a plane X, spanning between two headers 26, one at each end thereof. In addition, one or more support elements 28 may be provided transverse to the tubes 24, configured to maintain their positions relative to other tubes.

Figure 3A:
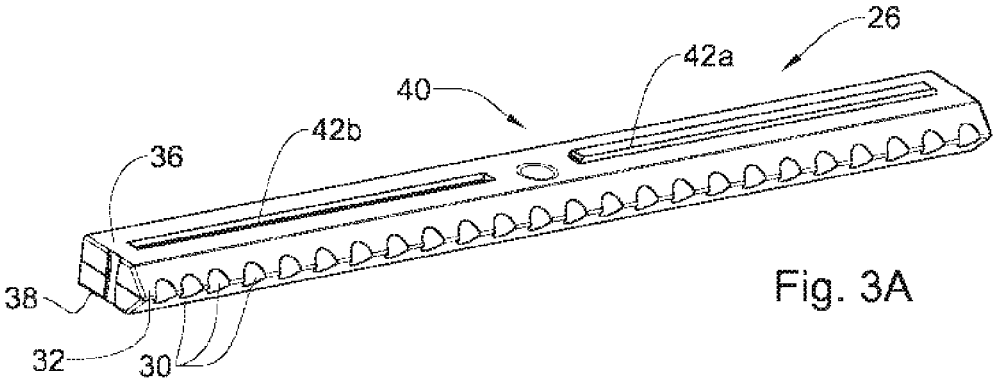
FIGS. 3A and 3B are, respectively, front and rear respective views of a header of the mat illustrated in FIG. 2.
Figure 3B:
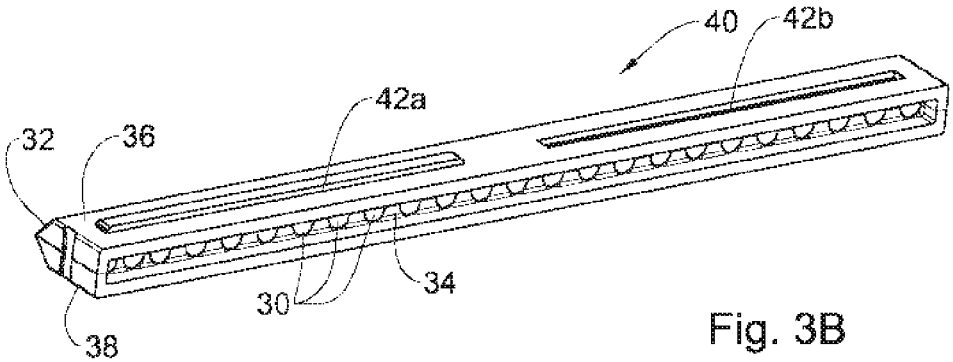

As seen in FIGS. 3A and 3B, each of the headers 26 comprises a plurality of through-going tube-apertures 30, each for receiving therein a tube 24, aligned linearly along an exchanger end 32 thereof, and which are in fluid communication with a header chamber 34, which is configured for being brought into fluid communication with one of the manifolds 22, as will be described below.

Top and bottom surfaces 36, 38 of the header 26 are formed with positioning features 40, designed to cooperate with similar corresponding positioning features on a header placed thereon to facilitate a stacked arrangement thereof. The positioning arrangements 40 may be configured such that the positioning features 40 on both the top and bottom surfaces 36, 38 of the header 26 are designed to cooperate with the positioning features on either the top or bottom surface of an adjacent header.

For example, a positioning projection 42*a* may be provided spanning lengthwise on one side of the length of the top surface 36, and a correspondingly formed positioning socket 42*b*, configured to receive within a positioning projection, is provided spanning lengthwise on the other side of the top surface. A similar positioning projection and socket (not illustrated) are formed on the bottom surface 38, on respective opposite sides (i.e., with the positioning socket of the bottom surface being formed on the same side along the length of the header 26 that the positioning projection 42*a* is formed on the top surface 36, and the positioning projection of the bottom face being formed on the same side along the length of the header that the positioning socket 42*b* is formed on the top surface). Accordingly, when two headers 26 are stacked one atop the other with the exchanger ends 32 thereof parallel to one another and facing the same direction, the positioning projections 42*a* of one will be aligned with the positioning sockets 42*b* of the other, irrespective of which of the top and bottom surfaces 36, 38 of each is facing upwardly.

The headers 26 may be made of a moldable material, such as a polymer, e.g., a thermoplastic or thermoset. Accordingly, the header 26 may be formed directly on the tubes 24 connected thereto, e.g., by an overmolding process, thereby simplifying manufacture of the mat 20 by obviating the need to insert a large number of tubes 24 into their respective headers 26. In addition, by providing the header 26 which is overmolded on the tubes 24, the tubes do not need to be welded, either to the header or the manifold 22, mitigating the risk of ends of the tubes being deformed such that flow through them is restricted and/or prevented.

Figure 4A:
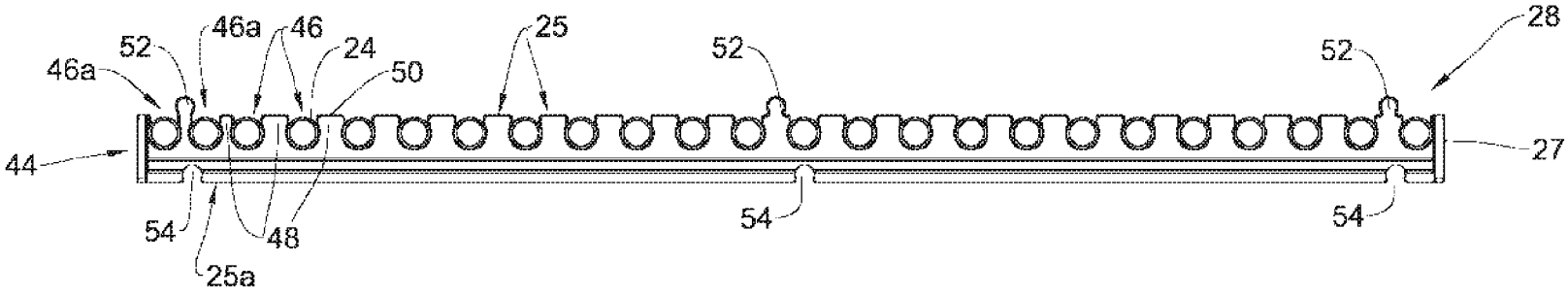
FIG. 4A is a front view of a support element of the mat illustrated in FIG. 2.

As illustrated in FIG. 4A, each of the support elements 28 comprises a gripping portion 44 spanning between two flat end surfaces 27 and having a plurality of seats 46, each for receiving therein one of the tubes 24. Each seat 46 is defined between two upwardly-projecting dividers 48, each of which may terminate in an outwardly-flared head 50, which facilitates maintaining a respective tube 24 therein. The support elements 28 may be made from a material which provides sufficient flexibility to bias adjacent dividers 48 outwardly in order to facilitate introduction of a tube 24 into the seat 46 defined therebetween.

The seats 46 may be evenly spaced along the length of the support element 28, giving rise to evenly sized gaps 25 between a majority of adjacent tubes 24 of each mat 20, with the exception of a small number (e.g., one or two) extreme seats 46*a* at one end, which is spaced from its adjacent seat by a different distance, for example a smaller distance, than are the other seats from one another, giving rise to auxiliary gaps 25*a* which are smaller than the other, evenly sized, gaps.

The support elements 28 may further comprise a linking arrangement configured to facilitate rigid connection of each support element to one adjacent thereto, i.e., on an adjacent mat 20. This rigid connection may contribute to the mat's 20 stability, e.g., withstanding vibrations due to fluids rushing rapidly past the tubes 24.

According to some examples, each of the linking arrangements may comprise upwardly-projecting linking tabs 52 and downwardly-facing linking slots 54, each configured to receive therein a linking tab, for example snappingly, thereby facilitating simple connection to an adjacent support element 28. It will be appreciated that the linking tabs 52 may face downwardly with the linking slots 54 facing upwardly, or be arranged in any other suitable manner, without departing from the scope of the presently disclosed subject matter, mutatis mutandis. The linking tabs and slots 52, 54 are spaced such that when one of the support elements 28 is disposed above the other, each of the linking tabs of one of the support elements is aligned with a corresponding linking slot of the other.

Figure 4B:
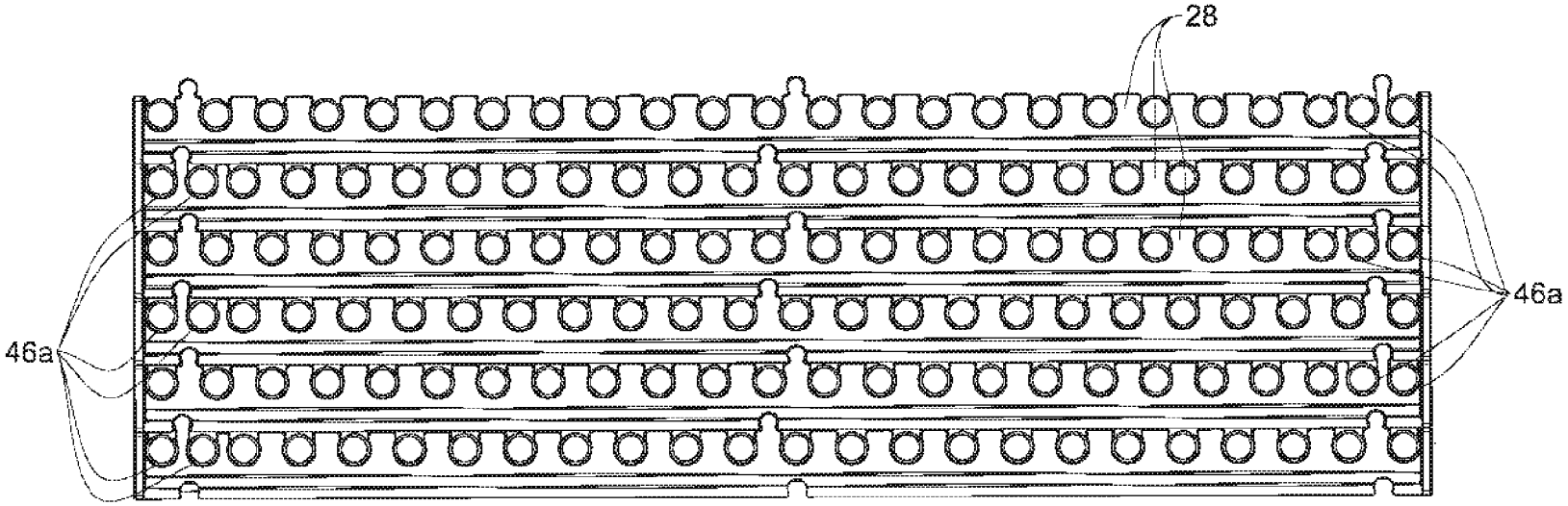
FIG. 4B is a front view of several of the support elements illustrated in FIG. 4A connected to each other.

According to some examples, the linking tabs and slots 52, 54 may be spaced such that each of the linking tabs of one of the support elements is aligned with a corresponding linking slot of the other only when they are reversed with respect to one another, i.e., the extreme seats 46*a* thereof are on opposite sides along their lengths, as illustrated in FIG. 4B. Accordingly, and owing to the different spacing of the extreme seats 46*a* from that adjacent to it, the tubes 24 of adjacent mats 20 are offset with respect to one another, such that each of the gaps 25, 25*a* is disposed such that it overlaps with the projection, which lies in a direction perpendicular to the planes X defined by the mats 20, of a tube of an adjacent mat. Accordingly, any path through the tubes 24 of the module which is perpendicular to the mats 20 necessarily impinges on a tube 24, even if it passes through a gap 25, 25*a* of a mat in front thereof. Such a "staggered" arrangement may facilitate airflow through the module 10 which transfers heat between the tubes and the environment more efficiently.

The support elements 28 may be further used to facilitate construction of the heat exchanger 12. As seen in FIG. 1B, several of the modules may be attached such that they are stacked. The support elements 28 may facilitate maintaining the tubes 24 is substantially horizontal positions, e.g., preventing them from assuming a catenary or similar shape under their own weights. In addition, the flat end surface 27 thereof may lie on each other, wherein vertically-stacked support elements 28 form a support structure, facilitating bearing the loads of all tubes 24, e.g., by the floor.

Figure 5:
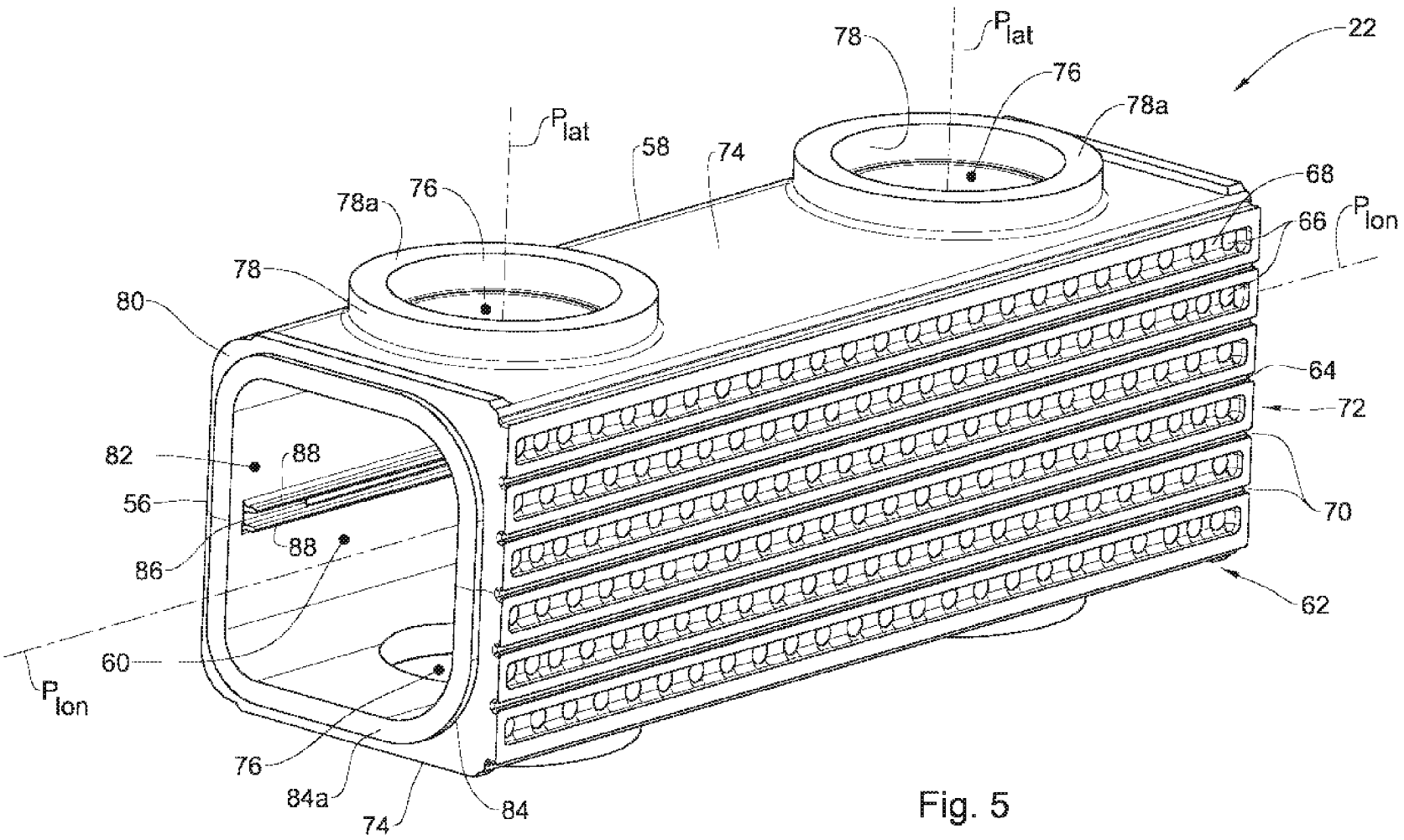
FIG. 5 is a perspective view of a manifold of the module illustrated in FIG. 1A.

As illustrated in FIG. 5, each of the manifolds 22 comprises a housing 58 defining therewithin a fluid chamber 60. A bottom surface 62 of the housing 58 is formed with a header-interface 64, configured for bringing the tubes 24 into fluid communication with the fluid chamber 60. The header-interface 64 comprises a plurality of parallelly-arranged rows of through-going apertures 66. The apertures 66 may be arranged to conform to the staggered 20 arrangement of tubes 24, for example as illustrated in FIG. 4. In addition, a channel 68 may be formed along each row, thereby insetting the apertures 66 below the surface of the header-interface 64. The channels 68 may be configured to lie in registration with the header chamber 34 of a corresponding header 26 when assembled to the manifold 22. The header-interface 64 may further comprise grooves 70 formed between the rows of apertures 66 defining 25 therebetween a plurality of bases 72 at the surface of the header-interface, each for contacting a header 26 when the mat 20 is assembled, for example for being welded thereto.

Side surfaces 74 of the housing 58 are each formed with one or more selectively sealable (i.e., configured to facilitate it to be sealed, thereby preventing flow of fluid therethrough, selectively) side openings 76 for attachment to an adjacent manifold, each defining a lateral flow path $P_{lat}$ therethrough. The lateral flow paths $P_{lat}$ are each substantially perpendicular to the planes defined by the tubes 24. A raised side-lip 78 may be formed about each side opening 76, constituting a welding surface for facilitating a sealing connection to another element, such as a cap, inlet/outlet or a corresponding side-lip of an adjacent manifold (thereby bringing the two manifolds into fluid communication with each other via the facing side openings), as described below. Accordingly, outer surfaces 78*a* of the side-lips 78 may be configured to substantially fully contact corresponding side-lips of an adjacent manifold 22 when two manifolds are disposed adjacently to another with the side surface 74 of one facing a side surface of the other, e.g., the outer surface of each side-lip may be flat and substantially parallel to a plane defined by the tubes 24 of one of the mats 20.

Ends 80 of the housing 58 are each formed with a selectively sealable end opening 82, for attachment to an adjacent manifold, and defining a longitudinal flow path $P_{lon}$ therebetween. The longitudinal flow path $P_{lon}$ is substantially perpendicular to the tubes 24 and the lateral flow path $P_{lat}$, and parallel to the planes defined thereby. A raised end-lip 84 may be formed around each end opening 82, constituting a welding surface for sealing connection to another element, such as a cap, inlet/outlet or a corresponding end-lip of an adjacent manifold (thereby bringing the two manifolds into fluid communication with each other via the facing end openings), as described below. Accordingly, an outer surface 84*a* of each end-lip 84 may be configured to substantially fully contact a corresponding end-lip of an adjacent manifold 22 when two manifolds are disposed adjacently to another with the end 80 of one facing the end of the other, e.g., the outer surface of each end-lip may be flat and substantially perpendicular to an axis traversing longitudinally through the fluid chamber 60.

Figure 6:
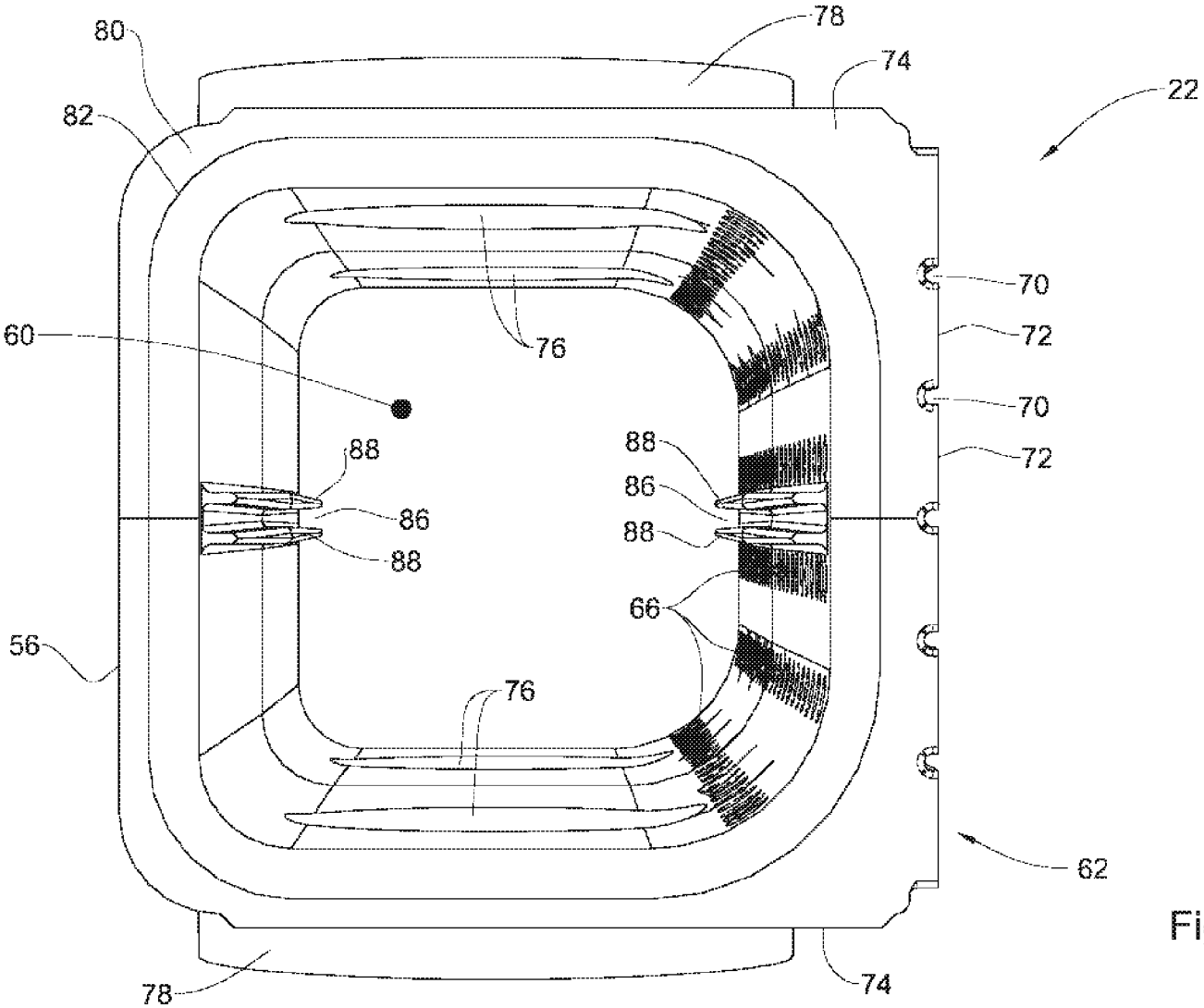
FIG. 6 is an end view of the manifold illustrated in FIG. 5.

As best seen in FIG. 6, an inner surface of the manifold 22 may be provided with a division arrangement of the manifold, comprising a pair of longitudinally extending slots 86, for example each defined between a pair of longitudinal projections 88. The slots 86 face one another, and are disposed between the side surfaces 74 of the housing 58, i.e., such that one of the slots is formed on an inner surface of the header-interface 64. The slots 86 may be formed halfway between the side surfaces 74, such that as many rows of apertures 66 (and thereby headers 26 attached to the manifold 22) are above them as are below them. The slots 86 are configured for receiving therein a partition (not illustrated in FIG. 6), thereby fluidly isolating two halves of the fluid chamber 60 defined thereby, and thus the headers 26 on either side thereof, from one another, for example to control fluid flow through the module 10, as will be described below. It will be appreciated that fluid isolation within the fluid chamber 60 is only considered within the chamber itself, e.g., it does not consider that fluid may cross the partition by exiting the chamber via an opening 76, 82 or via the header-interface 64.

Reverting to FIG. 1B, fluid access to the module 10 may be controlled by selectively blocking the side and end openings 76, 82 of the manifolds 22, and/or by facilitating access thereto. Side and end caps 90, 92 may be provided to seal the side and end openings 76, 82, respectively, for example being welded to the side- and end-lips 78, 84. Nipples 94 may be provided, for example to be connected lying in registration with side and/or end openings 76, 82, facilitating bringing the fluid chamber 60 of one or manifolds into fluid communication with an external fluid pipe. As illustrated, a nipple 94 may be provided on areas of the housing 58 not formed with an opening, for example by a user cutting an opening in a top surface 56 (as indicated in FIG. 5) of the housing as necessary.

Several modules 10 may be assembled together to form the heat exchanger 12. According to some examples, modules 10 are arranged with the manifolds on each side thereof stacked together, such that side surfaces 74 thereof face each other, with side-lips 78 thereof lying in registration with those of adjacent modules, i.e., outer surfaces 78*a* of the side-lips contacting one another, defining side junctions 100 therebetween. (Herein, reference numeral may be used to refer collectively to all reference numerals which include the same number followed by a trailing letter and/or prime, e.g., 100 may be used to refer collectively to 100'*a*, 100'*b*, 100"*a*, 100"*b*, etc. Similarly, 100' may be used to refer collectively to 100'*a*, 100'*b*, etc., and 100*a* may be used to refer collectively to 100'*a* and 100"*a*.) Two or more modules 10 so stacked constitute a lateral subassembly 150 of the heat exchanger, spanning between first and second ends 102', 102" defined by the manifolds 22. In the present disclosure, the prime notation is used to refer to corresponding side junctions 100 formed between opposite ends 102 of the same manifolds, i.e., side junction 100*a* is formed between first ends 102' of the same pair of adjacent manifolds 22 between the second ends 102" of which side junction 100'*a* is formed.

Figure 7B:
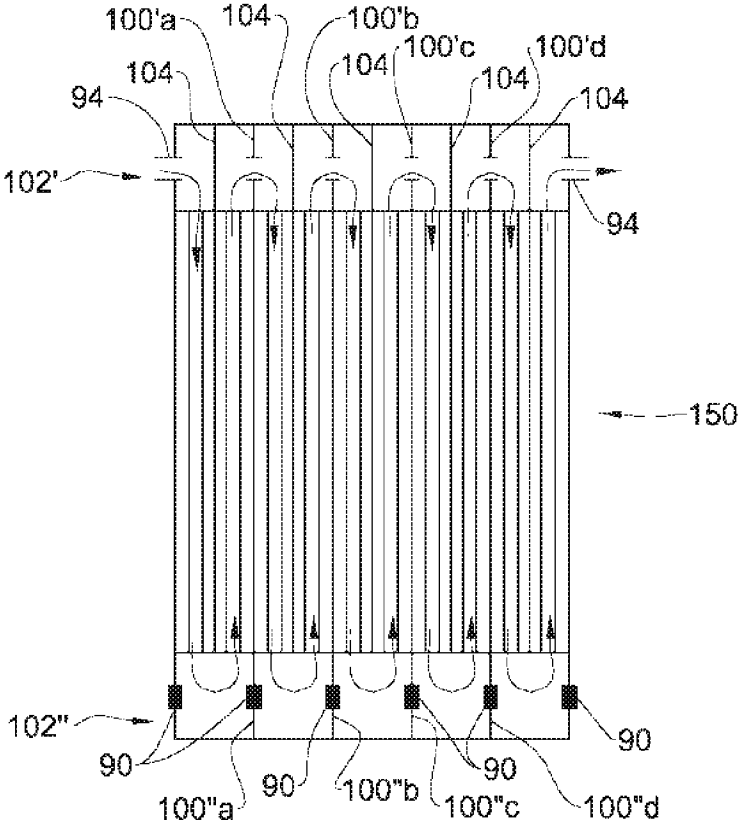
FIGS. 7A and 7B are schematic illustrations of assembly of several of the mats illustrated in FIG. 1A.
Figure 7A:
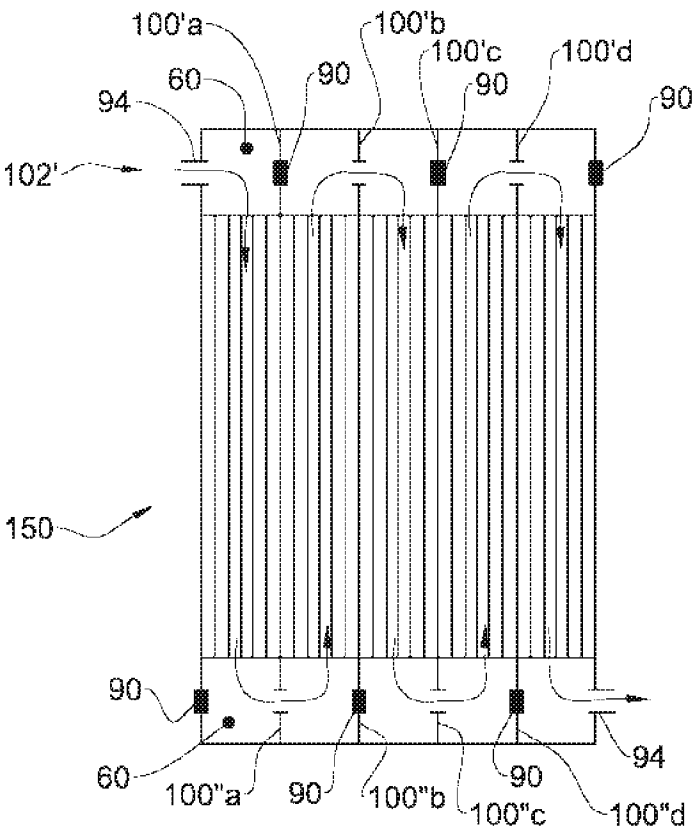

The lateral subassembly 150 may be configured to regulate fluid flow therethrough. According to some examples, as illustrated schematically in FIG. 7A, alternating side junctions 100' on the first end 102' may be connected to one another, bringing the fluid chambers 60 of pairs of manifolds 22 in fluid communication with one another, with the other side junctions 100' of the first end 102' being sealed, e.g., with side caps 90, to prevent fluid flow between adjacent manifolds therethrough. Similarly, alternating side junctions 100" on the second end 102", each of which corresponds to a sealed side junction 100' of the first end 102', are connected to one another, bringing the fluid chambers 60 of pairs of manifolds 22 in fluid communication with one another, with the other side junctions 100" of the second end 102" being sealed, e.g., with side caps 90, to prevent fluid flow between adjacent manifolds therethrough. Accordingly, fluid within the lateral subassembly 150 flows through each mat 20 in succession, with the direction of fluid flow being reversed between adjacent modules, as indicated by arrows. Nipples 94 may be provided as necessary at the entrance and exit of the fluid flow path so defined.

According to other examples, all of the side junctions 100' of the first end 102' are left unsealed, and all of the side junctions 100" of the second end 102" are sealed. In addition, partitions 104 are provided in the manifolds 22 of the first end 102', thereby fluidly isolating some of the headers 26 of each module 10 from the others within the manifold 22. Accordingly, fluid within the lateral subassembly 150 flows through each mat 20 in succession in both direction, reversing direction one time therewithin. It will be appreciated that the manifolds 22 may be configured to receive more than one partitions, thereby allowing reversing of fluid flow more than once within each Nipples 94 may be provided as necessary at the entrance and exit of the fluid flow path so defined.

It will be appreciated that the heat exchanger 12 may comprise a single module 10, a single lateral subassembly 150, one or more modules connected only by end openings 82 thereof, several lateral subassemblies connected by end openings thereof, any of the above or other combinations modified by connecting adjacent manifolds 22 via holes cut by a user in top surfaces 56 thereof (e.g., as illustrated in FIG. 1B), or any other suitable arrangement of modules, without departing from the scope of the presently disclosed subject matter, mutatis mutandis.

Figure 8A:
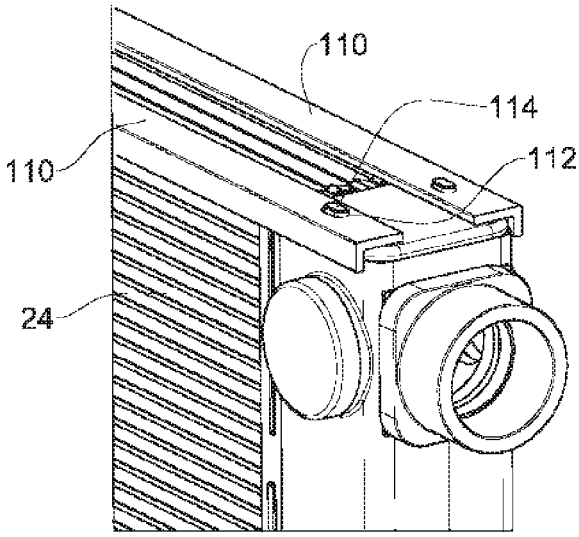
FIGS. 8A and 8B are close-up views of, respectively, the module illustrated in FIG. 1A and the heat exchanger illustrated in FIG. 1B, showing a flow blocker.
Figure 8B:
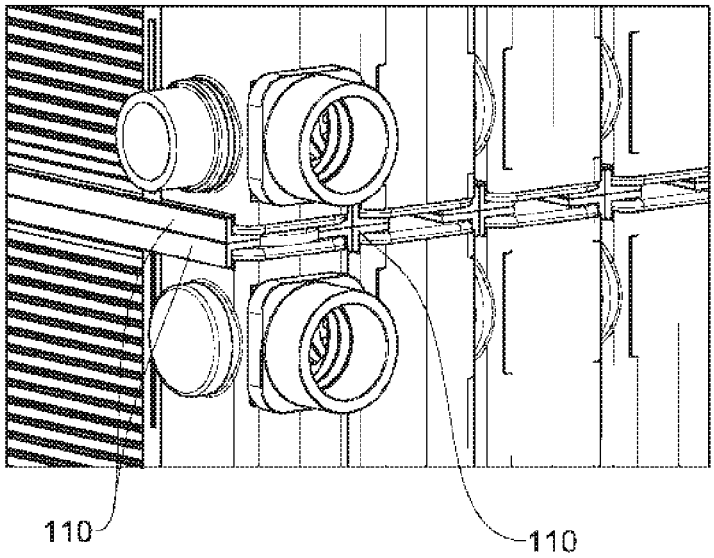
Figure 8C:
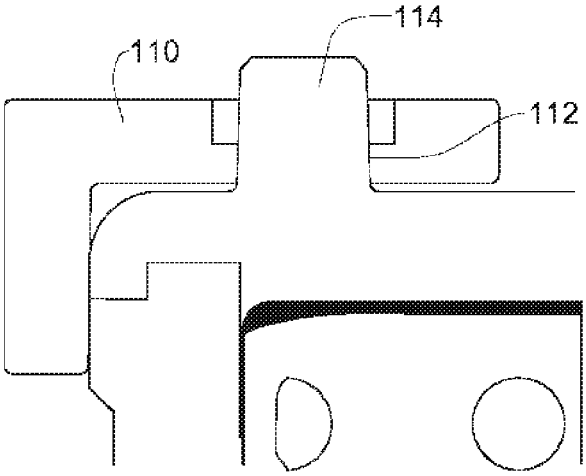
FIG. 8C is a cross-sectional close up view of the flow blocker illustrated in FIGS. 8A and 8B mounted on the module, before being secured thereto.

As illustrated in FIGS. 8A and 8B, the heat exchanger 12 may be provided with flow blockers 110 between adjacent modules 10, configured to fill the space therebetween, thereby ensuring that fluid transverse to the heat exchanger 12 passes across the tubes 24, where heat exchange primarily takes places. The flow blockers 110 may be L-shaped, with positioning apertures 112 formed therein. The modules 10 are formed with pins 114, for example provided on the manifolds 22, for mating with the positioning apertures 112. As seen in FIG. 8C, the positioning apertures 112 may have a diameter similar to that of the pin, and a wider diameter on an upper portion thereof. Accordingly, the pin 114 can be melted to fill the void within the upper diameter of the positioning apertures 112, thereby filling it and locking the flow blocker 110 in place. The pin 114 may be taller than the height of the positioning apertures 112, thereby providing material to fill the upper diameter when melted.

Those skilled in the art to which this invention pertains will readily appreciate that numerous changes, variations and modifications can be made without departing from the scope of the invention mutatis mutandis.

The invention claimed is:

1. A module for constructing therefrom a heat exchanger, the module comprising:

two manifolds; and a plurality of parallelly arranged mats spanning between the manifolds, each mat comprising a plurality of heat exchange tubes arranged so as to define a plane, said heat exchange tubes being in fluid communication with the manifolds and spanning therebetween;

wherein at least one of the manifolds comprises a division arrangement configured to facilitate selectively fluidly isolating one or more of said mats from the tubes of the other mats.

2. The module according to claim 1, wherein said division arrangement is configured to divide an internal fluid chamber of said manifold along a plane substantially parallel to the planes defined said mats.

3. The module according to claim 1, wherein said division arrangement comprises one or more pairs of oppositely disposed slots on an interior surface of said manifold and is configured to receive a partition spanning therebetween.

4. The module according to claim 3, wherein said slots extend longitudinally along the length of the manifold.

5. The module according to claim 1, the tubes in each mat being spaced from one another giving rise to gaps therebetween, wherein each of said gaps is disposed such that it overlaps with projections, in a direction perpendicular to said planes, of one or more tubes of other of said mats.

6. The module according to claim 5, wherein a majority of the gaps in each mat are of the same size, each of said mats further comprising one or more auxiliary gaps of a different size.

7. The module according to claim 6, wherein said auxiliary gaps are formed adjacent extreme tubes disposed on one end of their respective tubes.

8. The module according to claim 7, wherein said mats are arranged such that extreme tubes of adjacent mats are on alternate sides thereof from one another.

9. The module according to claim 8, each mat further comprising a support element configured to grip each of said tubes and maintain its position, each of said support elements being further configured to be rigidly connected to a support element of an adjacent mat so as to preclude an arrangement wherein said mats overlie one another with said extreme tubes thereof on the same sides thereof.

10. The module according to claim 9, said support elements comprising a linking arrangement configured to cooperate with the linking arrangement of an adjacent support element to facilitate the rigid connection.

11. The module according to claim 10, wherein said linking arrangements comprise tabs and slots.

12. The module according to claim 6, wherein said auxiliary gaps are smaller than said majority of the gaps.

13. The module according to claim 12, wherein each of said mats comprises two adjacent auxiliary gaps.

14. The module according to claim 5, wherein each of said gaps is disposed such that it overlaps with projections, in a direction perpendicular to said planes, of a tube of an adjacent mat.

15. The module according to claim 5, wherein each of said gaps fully overlaps with said projections.

16. The module according to claim 1, each mat comprising one or more support elements disposed coplanar therewith and transverse to said tubes, said support elements being configured to grip each of said tubes and maintain its position, each of said support elements being further configured to be rigidly connected to a support element of an adjacent mat.

17. The module according to claim 16, said support elements comprising a linking arrangement configured to cooperate with the linking arrangement of an adjacent support element to facilitate the rigid connection.

18. The module according to claim 17, wherein said linking arrangement facilitate snapping connection with an adjacent support element.

19. The module according to claim 17, wherein said linking arrangements comprise tabs and slots.

20. A heat exchanger comprising one or more modules according to claim 1.

* * * * *